US011459795B2

(12) United States Patent
Ross et al.

(10) Patent No.: US 11,459,795 B2
(45) Date of Patent: Oct. 4, 2022

(54) ELECTRIC STRIKE

(71) Applicant: RMD INNOVATIONS PTY. LTD., Thornbury (AU)

(72) Inventors: Geoff Ross, Wheelers Hill (AU); Andrew Marget, Malvern East (AU); Philip Millikin, Junortoun (AU); Michael Maloney, Helidon Spa (AU)

(73) Assignee: RMD INNOVATIONS PTY. LTD., Thornbury (AU)

( * ) Notice: Subject to any disclaimer, the term of this patent is extended or adjusted under 35 U.S.C. 154(b) by 488 days.

(21) Appl. No.: 16/471,659

(22) PCT Filed: Dec. 21, 2017

(86) PCT No.: PCT/AU2017/051431
§ 371 (c)(1),
(2) Date: Jun. 20, 2019

(87) PCT Pub. No.: WO2018/112537
PCT Pub. Date: Jun. 28, 2018

(65) Prior Publication Data

US 2019/0316382 A1 Oct. 17, 2019

(30) Foreign Application Priority Data

Dec. 21, 2016 (AU) ..... 2016905287

(51) Int. Cl.
*E05B 47/00* (2006.01)
*E05B 41/00* (2006.01)
(Continued)

(52) U.S. Cl.
CPC ..... *E05B 47/0046* (2013.01); *E05B 41/00* (2013.01); *E05B 47/0002* (2013.01);
(Continued)

(58) Field of Classification Search
CPC .. E05B 47/0046; E05B 41/00; E05B 47/0002; E05B 47/0012; E05B 63/0069;
(Continued)

(56) References Cited

U.S. PATENT DOCUMENTS 3,751,088 A 8/1973 Schlage et al.
5,850,753 A 12/1998 Varma
(Continued)

OTHER PUBLICATIONS

International Search Report and Written Opinion for Application No. PCT/AU2017/051431 dated Mar. 15, 2018 (9 pages).

*Primary Examiner* — Lloyd A Gall
(74) *Attorney, Agent, or Firm* — Michael Best & Friedrich LLP

(57) ABSTRACT

An electric strike for a door frame, comprising: a body; a keeper moveably attached to the body for selectively retaining a latch bolt on a door; a blocking element movable between a blocking position in which the blocking element locks the keeper to prevent a latch from being moved past the keeper, and an unblocking position in which the blocking element unlocks the keeper to allow the latch to move past the keeper; an electronically controlled electric actuator for
(Continued)

moving the blocking element between the blocking position and the unblocking position; and an override mechanism to override the electric actuator.

18 Claims, 15 Drawing Sheets

(51) Int. Cl.
*E05B 63/00* (2006.01)
*G07C 9/00* (2020.01)

(52) U.S. Cl.
CPC ..... *E05B 47/0012* (2013.01); *E05B 63/0069* (2013.01); *G07C 9/00182* (2013.01); *E05B 2047/0086* (2013.01); *E05B 2047/0095* (2013.01); *E05Y 2900/132* (2013.01); *G07C 2009/0019* (2013.01)

(58) Field of Classification Search
CPC ..... E05B 2047/0086; E05B 2047/0095; E05B 47/0004; E05B 2047/0069; E05B 47/0047; G07C 9/00182; G07C 2009/0019
USPC ..... 70/278.7, 279.1; 292/144, 341.16
See application file for complete search history.

(56) References Cited

U.S. PATENT DOCUMENTS

| | | | | |
|---|---|---|---|---|
| 7,032,418 | B2 * | 4/2006 | Martin | E05B 65/08 292/341.16 |
| 7,185,928 | B1 * | 3/2007 | Liao | E05B 47/0047 292/341.15 |
| 7,540,542 | B2 * | 6/2009 | Geringer | E05B 47/0047 292/341.16 |
| 8,047,582 | B1 * | 11/2011 | Rodgers | E05B 65/0007 292/201 |
| 8,047,585 | B1 * | 11/2011 | Peabody | E05B 47/0046 292/341.16 |
| 8,807,606 | B2 * | 8/2014 | Ross | E05B 47/0047 292/220 |
| 2010/0096864 | A1 * | 4/2010 | Webb | E05B 47/0047 292/341.16 |
| 2010/0127517 | A1 * | 5/2010 | Bliding | G07C 9/00944 292/341.16 |
| 2010/0127518 | A1 * | 5/2010 | Huang | E05B 47/0047 292/341.16 |
| 2010/0139338 | A1 * | 6/2010 | Wintersteiger | E05B 47/0607 70/78 |
| 2013/0009409 | A1 * | 1/2013 | Chang | E05B 47/0047 292/64 |
| 2013/0269403 | A1 | 10/2013 | Kowalczyk | |

* cited by examiner

ELECTRIC STRIKE

FIELD OF THE INVENTION

The invention relates to an electric strike for a door frame.

BACKGROUND OF THE INVENTION

Electric strikes are commonly installed on door frames to allow access through a locked door without needing to provide everyone with a physical key. Instead, the electric strike, which is connected to the building's electricity supply, has an RFID scanner that unlocks a keeper in the electric strike to allow access through the door. A disadvantage of these systems is that when power is lost to the building the electric strike will either need to enter either a fail-safe mode in which the keeper is unlocked and the door is accessible to everyone, or a fail-secure mode in which the keeper is locked and the door cannot be opened using the electric strike. In addition, the ability to restrict access to the building can be complex, requiring access to be suspended to all RFID cards.

It is in view of this disadvantage that the current invention was conceived.

SUMMARY OF THE INVENTION

In accordance with the invention there is provided an electric strike for a door frame, comprising: a body; a keeper moveably attached to the body for selectively retaining a latch bolt on a door; a blocking element movable between a blocking position in which the blocking element locks the keeper to prevent a latch from being moved past the keeper, and an unblocking position in which the blocking element unlocks the keeper to allow the latch to move past the keeper; an electronically controlled electric actuator for moving the blocking element between the blocking position and the unblocking position; and an override mechanism to override the electric actuator.

By providing such an override mechanism in an electric strike, the override mechanism can take over the function of the actuator to either move or not move the blocking element.

In an embodiment, the override mechanism prevents the blocking element from moving to the un-blocking position when the electronically controlled actuator is activated. By providing an override mechanism that prevents the blocking element from moving to the un-blocking position when the electronically controlled actuator is activated it is possible to deadlock the electric strike, and therefore easily restrict access to a building on which the electric strike is installed.

In an embodiment, the override mechanism moves the blocking element from the blocking position to the un-blocking position when the electronically controlled actuator is not activated. By providing an override mechanism that moves the blocking element from the blocking position to the un-blocking position when the electronically controlled actuator is not activated it is possible to have a fail-secure electric strike that also provides a safe way for people to exit the door.

In an embodiment the override mechanism is a mechanically operated mechanism. The override mechanism may comprise an override member that contacts the blocking element to move the blocking element from the blocking position to the non-blocking position. The override member may be a sliding bar, also referred to herein as a push bar. The push bar may reciprocate. The override mechanism may comprise a key cylinder associated with the override member where the key cylinder is accessible from an outside and/or an inside of the door. Rotation of a key in the key cylinder may drive the override member to move the blocking element into the un-blocking position.

In an embodiment the override mechanism comprises a push button. The push button may co-exist with the embodiment of the override mechanism being a key cylinder. The push button may be located on the inside of a door and drive the override member to move the blocking element into the unblocking position. This allows any user inside to easily get out by using a mechanical override button.

In an embodiment the keeper is pivotally attached to the body. When the blocking element is in the blocking position the blocking element may impede rotation of the keeper.

In an embodiment the electronically controlled actuator is an electric motor. The electric motor may be battery operated. The battery may be located within the body of the electric strike. The electronically controlled actuator is remotely activated.

BRIEF DESCRIPTION OF THE DRAWINGS

An embodiment, incorporating all aspects of the invention, will now be described by way of example only with reference to the accompanying drawings in which.

DETAILED DESCRIPTION OF AN EMBODIMENT OF THE INVENTION

Figure 1A:
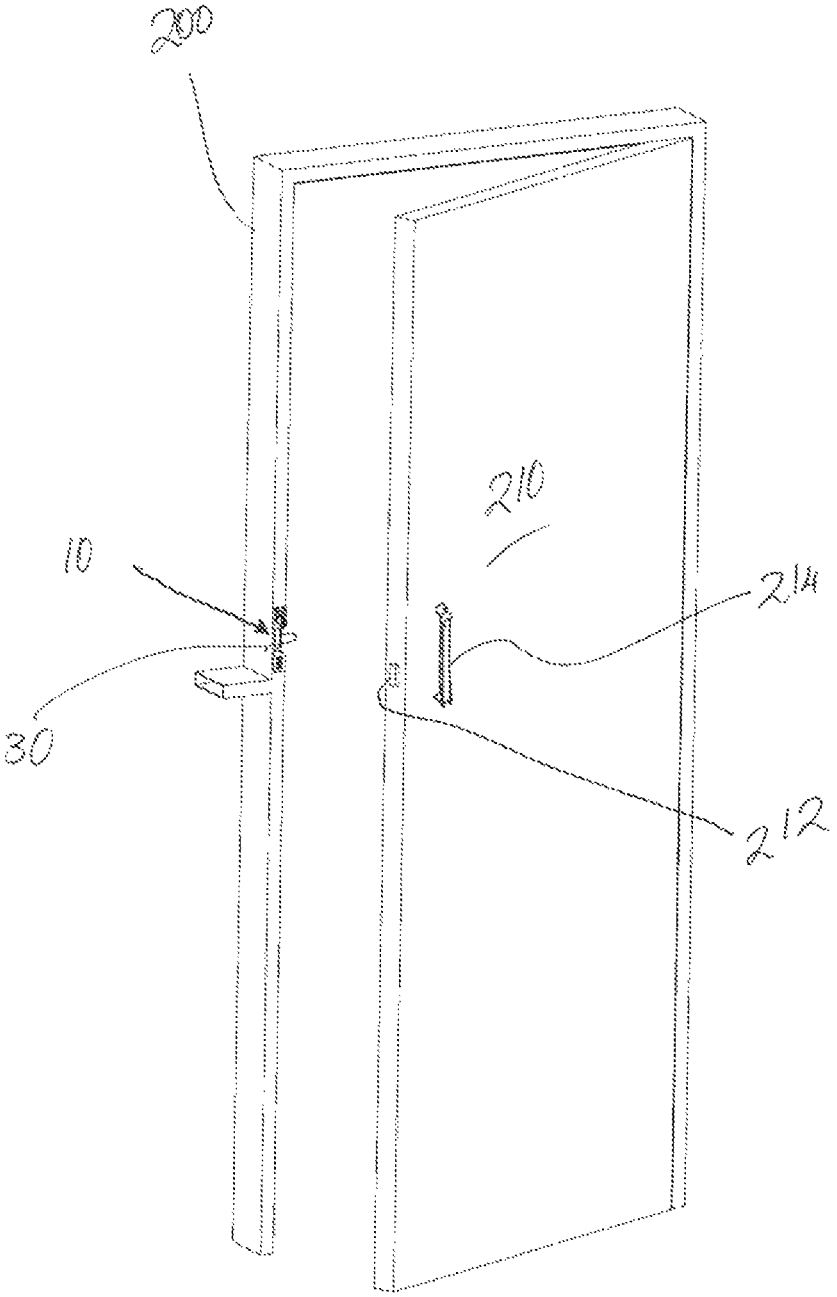
FIG. 1A is an isometric view of an electric strike installed on a door frame.
Figure 1B:
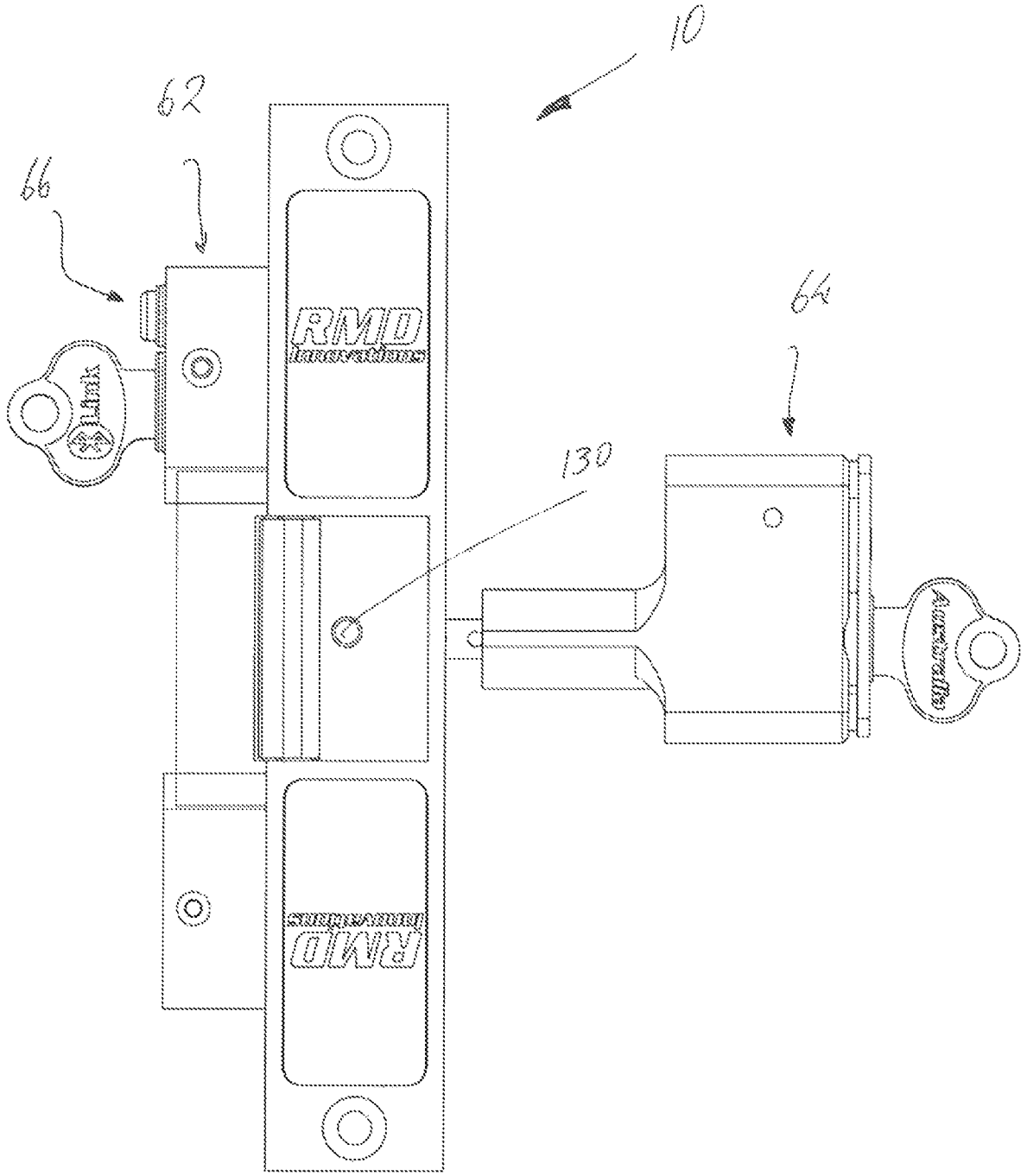
FIG. 1B is a side view of the electric strike.

FIGS. 1A to 8E illustrate an electric strike 10, 200 for a door jamb 200 that provides for, and is capable of selecting between, electronic access and mechanical access through a door 210. For example, the electric strike can be used to unlock a door using electronic access such as a swipe card. Additionally, the electronic strike allows for mechanical access such as a key or mechanical push button, that will override the electronic access or even block electronic access.

Specifically, the strike 10, 200 can block electronic access so that only a mechanical override will open the access. This may be useful, for example, where it is desired to lock out from a premises users who normally have electronic access in the form of a swipe card, so that only personnel with a physical, mechanical key can enter. This is described herein as a 'lock out' function where only a physical key will unlock the door and lock out any other form of access into a premises.

Accordingly, the present electric strike with mechanical override can be set to a deadlocked position where electronic access cannot open a door, but only a user with a physical key can mechanically open the door from an exterior. A mechanical override in the form of a key may also, in this situation, be required to open the door from an inside of the door and/or a push button could be provided to exit from an inside.

The first embodiment of the electric strike 10 shown in FIGS. 1A to 7 is a battery operated (but can be hard wired) motor that actuates to allow and prevent a latch bolt from retracting in order to allow and prevent access through a door. The second embodiment illustrated in FIGS. 8A to 8E is a similar electric strike 200 to the first embodiment in almost all respects (and same parts are attributed the same reference numbers) but the actuator in the second embodiment is not a motor but rather a solenoid that is hard wired into the electronics of a building.

The electric strike (see for example FIG. 2B) has a body 20 and a keeper 30 moveably attached to the body 20 for selectively retaining a latch bolt 212 on a door 210. The electric strike 10 has a blocking member, shown as blocking element 40, movable between a blocking position in which the blocking element 40 locks the keeper 30 to prevent the latch bolt 212 from being moved past the keeper 30, and an un-blocking position in which the blocking element 40 unlocks the keeper 30 to allow the latch bolt 212 to move past the keeper 30. The electric strike 10 has an electronically controlled electric actuator, which in the first embodiment is shown as motor 50 and in the second embodiment is shown as solenoid 250, for moving the blocking element 40 between the blocking position (FIGS. 3A, 8B) and the non-blocking position (FIGS. 3B, 8C).

The blocking element 40 can also be moved from the blocking position to the non-blocking position by actuation of an override mechanism 60. The electric strike can therefore be unlocked in multiple ways, either through actuation of the motor 50/solenoid 250 (via an RFID scanner actuated with a swipe card), or through an override mechanism 60 (described herein as mechanical in nature).

Referring to FIG. 1A, the electric strike 10 is installed on a door jamb 200. The door 210 has a handle actuated latchbolt 212 that can be locked so that the latchbolt 212 cannot be retracted by the handle 214 (as the handle is locked and prevented from movement). The handle may be a rotating lever or knob-style handle or a simple fixed handle that is grasped to push or pull the door. When the door 210 is closed the latchbolt 212 of the door 210 extends from the door 210 and into a void or recess in the electric strike 10. If the door handle 214 is locked then the handle 214 cannot be used to retract the latchbolt 212, and the door can only be opened if the keeper 30 is free to move (i.e. the electric strike is unlocked) to allow the latchbolt 212 to move past the keeper 30.

The keeper 30 is mounted on a shaft 32 that allows the keeper to pivot relative to the body 20 of the electric strike 10. The keeper 30 is biased towards a closed position by a biasing member, shown as return spring 34. The return spring 34 is coiled around the shaft 32.

Referring first to unlocking the electric strike 10 using the motor 50, and specifically to FIGS. 2B, 3A, 3B and 6, the motor 50 has a shaft 52 that is rotated by the motor 50. The shaft 52 has projections 54 that rotate with the shaft 52. A spring housing 90 with first and second openings 91, 92 houses a spring, shown as coil spring 94. The shaft 52 of the motor 50 extends through the first and second opposite openings of the spring housing 90. The spring 94 is coiled around the shaft 52 so that the projections 54 sit between adjacent coils of the spring 94. As the motor 50 rotates the shaft 52 the projections 54 rotate inside the coils of the spring 94 and effectively screw the spring 94, which is retained and prevented from rotating by the spring housing 90, causing the spring housing 90 to move axially along the motor shaft 52, moving from a first position (FIG. 3A) to a second position (FIG. 3B). The electronic chip 99 provides a current for a predetermined time to the motor 50 to drive the shaft 52 a predetermined number of rotations, thereby causing the spring housing 90 to move from the first position to the second position.

The spring housing 90 is directly attached to the blocking element 40, meaning that linear movement of the spring housing 90 causes movement of the blocking element 40. The spring 94 acts to bias the spring housing 90 into the first position (FIG. 3A), and thereby bias the blocking element 40 into the blocking position. When the spring housing is driven to the second position (FIG. 3B) the blocking element 40 is linearly moved from the blocking position into the unblocking position. When the spring housing 90 is in the second position the spring acts to bias the spring housing 90 into the second position, thereby biasing the blocking element 40 into the un-blocking position. The spring acts to bias the spring housing to an extended, unblocked position, but will move only by rotation of shaft 52.

After a predetermined time (sufficient time to allow a person to open the door) the motor 50 reverses the aforementioned predetermined number of rotations to return the spring housing to the first position. Actuation of the electronically controlled actuator can therefore be used to temporarily unlock the electric strike 10 to allow a user to open the door 210 when the door handle 214 is locked. Alternatively, the electric strike may have a sensor, shown as pin 130 and electric switch 132, that determines whether the latchbolt has returned to the "door closed" position, and sends this information to the electronic chip 99 to trigger the motor retracting to return the blocking element to the blocking position once the door is closed.

The user is able to open the door 210 because the keeper 30 is free to move, allowing the latchbolt 212 to push past the keeper 30. In other words, when the blocking element is in the un-blocking position the door can be opened as the latchbolt 212 will not be retained by the keeper 30. Instead, the latchbolt 212 will force its way past the keeper 30 by contacting the keeper 30 and causing it to rotate out of the way of the latchbolt 212.

Referring now to the override mechanism 60, it is envisaged that there can be more than one override actuators associated with the override mechanism 60 to actuate the override mechanism. As shown in the figures, the electric strike 10 has three override actuators, shown as indoor key override actuator 62, outdoor key override actuator 64, and indoor push-button override actuator 66. The mechanical override actuators of the override mechanism provide the ability to move the blocking element 40, which is a substantially planar member, out of the blocking position (which is its normal rest position) and into the un-blocking position, thereby allowing access through the door. This is especially helpful if power is lost to the electric strike 10 and the electronically controlled actuator cannot be actuated.

The mechanical override mechanism also has the ability of preventing movement of the blocking element 40 out of the blocking position, to thereby stop the strike from opening an access electronically. This may be useful if it desired to prevent access during certain periods (eg holidays, weekends) to personnel who otherwise have electronic access to enter a building.

Referring to FIGS. 2B to 4C, the override mechanism 60 will now be discussed. The override mechanism 60 comprises an override member, shown as a sliding push bar 70 that slides within housing body 20 and is actuated by one or more of the mechanical override actuators including an indoor key override actuator 62, and outdoor key override actuator 64 and an indoor push-button override actuator 66. The push bar 70 can reciprocate in the body 20 of the electric strike 10 between a deadlocked position (FIG. 2B), a neutral position (FIGS. 3A and 3B) and an unlocked position (FIGS. 4A, 4B and 4C) to block or move the blocking element 40.

In the deadlocked position the push bar stops the blocking element from moving out of the blocking position.

In the neutral position the push bar 70 does not interfere with the electronic actuation of the blocking element 40. This is the normal condition in which electronic access through the door fitted with the electronic strike is allowed.

In the unlocked position the push bar has itself moved the blocking element into the unblocking position thereby mechanically overriding the opening operation without relying on any electronic unlocking of the strike.

Figure 4A:
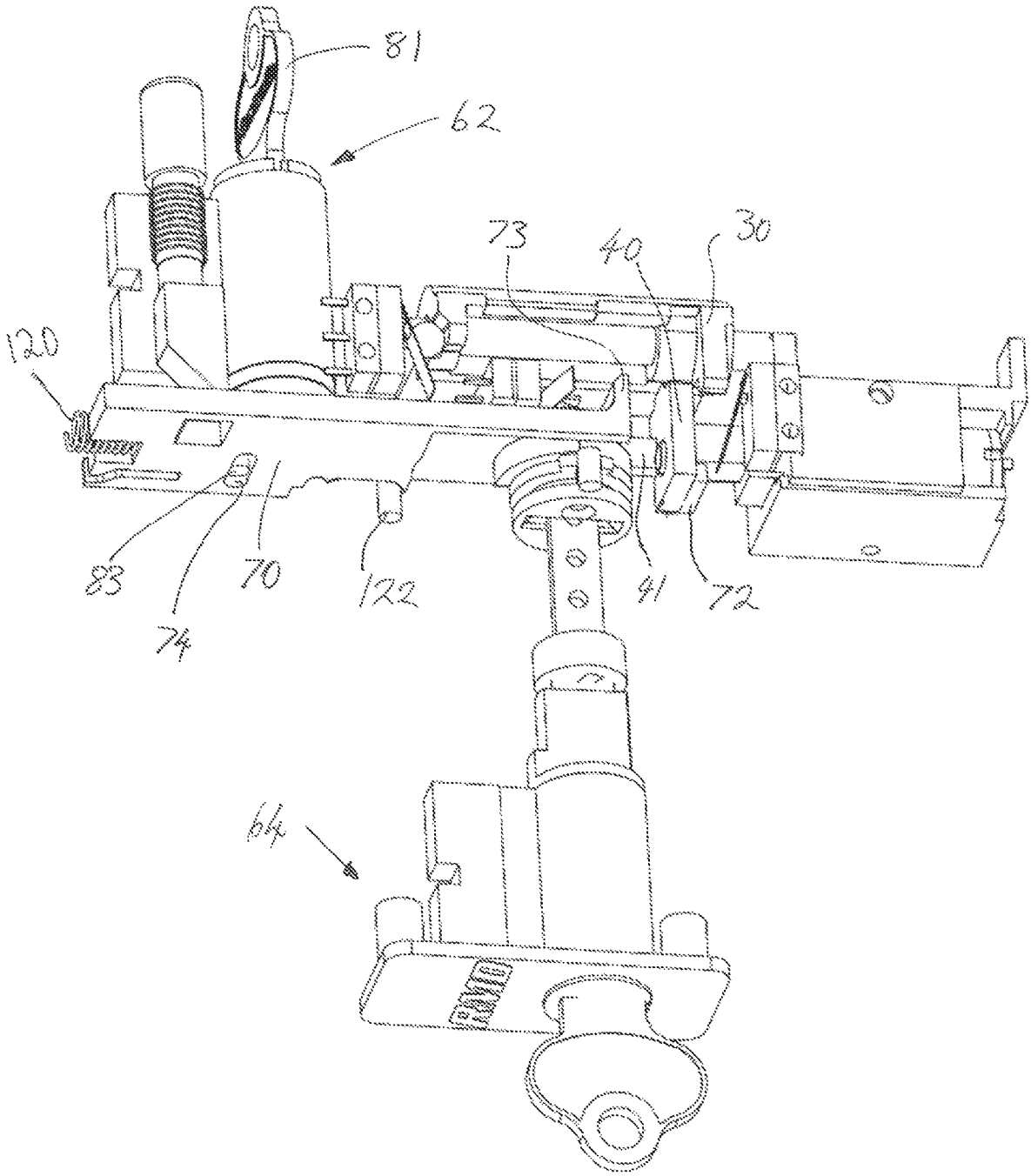
FIG. 4A is an isometric view of the electric strike shown in FIG. 3A in the unlocked position with the blocking element driven into the un-blocking position by the inside door override mechanism.

In order to move the blocking element 40 from the blocking position to the non-blocking position the push bar 70 contacts the blocking element 40 to pull the blocking element 40 from the blocking position to the non-blocking position. Specifically, the push bar 70 has two contact surfaces 72 and 73 that are joined by a bridge or bridging arm 41. Blocking element 40 sits over and slides on arm 41 in between contact surfaces 72 and 73, where the blocking element is captured between the contact surfaces. A first contact surface 72 contacts one side of blocking element 40 in order to pull the blocking element into the non-blocking position (FIG. 4A). The second contact surface 73 contacts the other, opposite side of blocking element 40 to stop it moving from the blocking position to the un-blocking position regardless of whether the motor 50 is actuated.

Figure 2A:
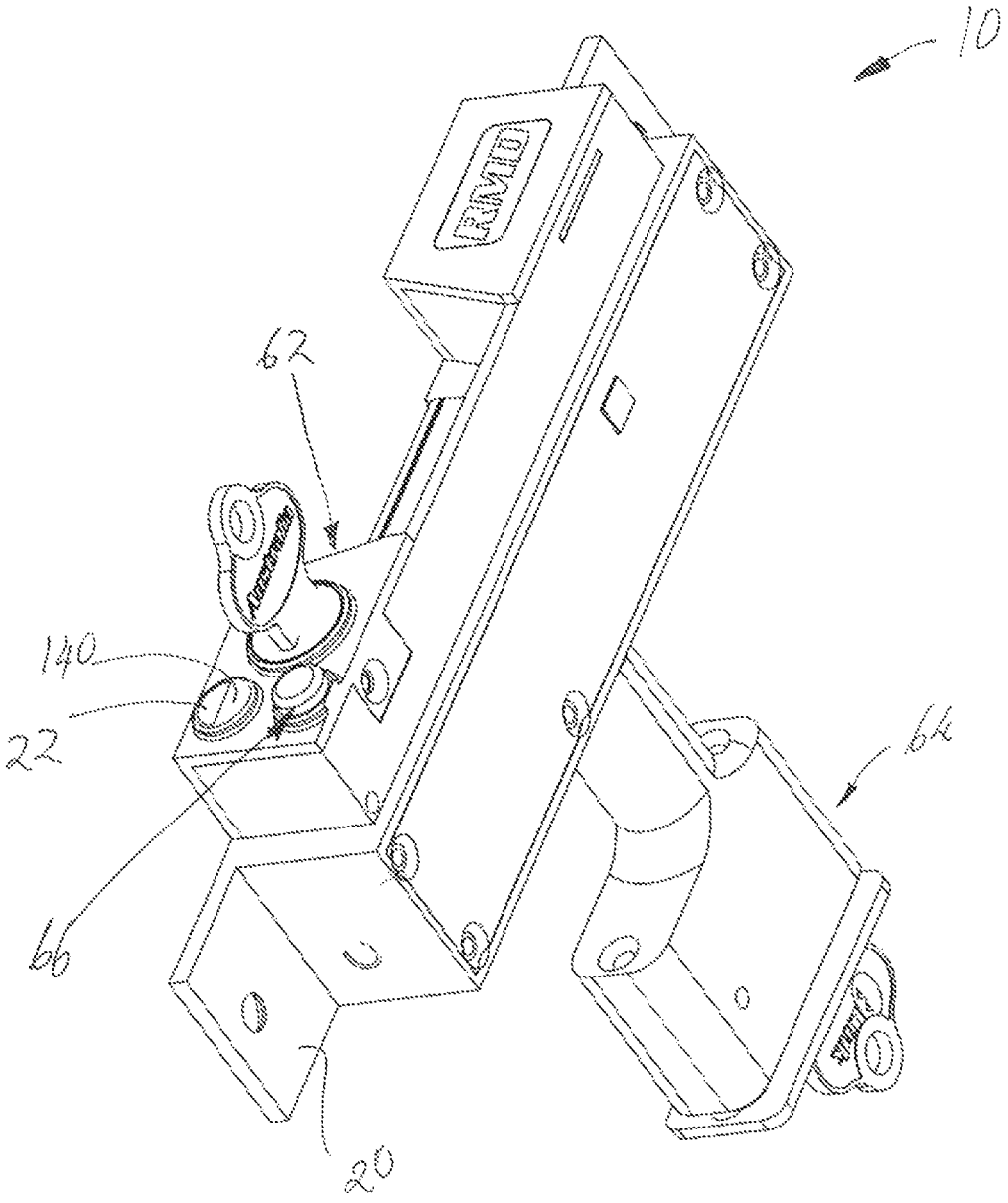
FIG. 2A is an isometric view of the electric strike shown in FIG. 1B.
Figure 2B:
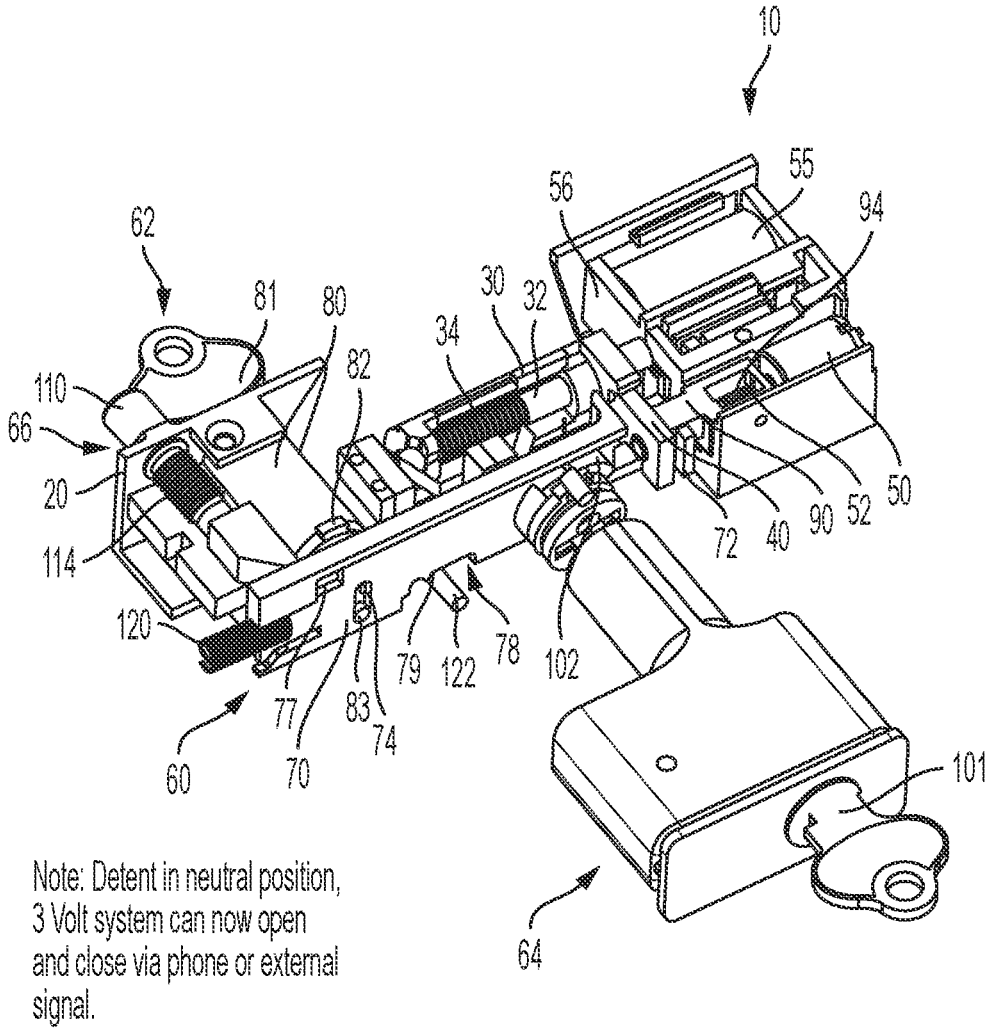
FIG. 2B is an isometric view of the electric strike shown in FIG. 2A with the housing removed so that the internal components of the lock can be seen, and where the electric strike is in a deadlock position.
Figure 3A:
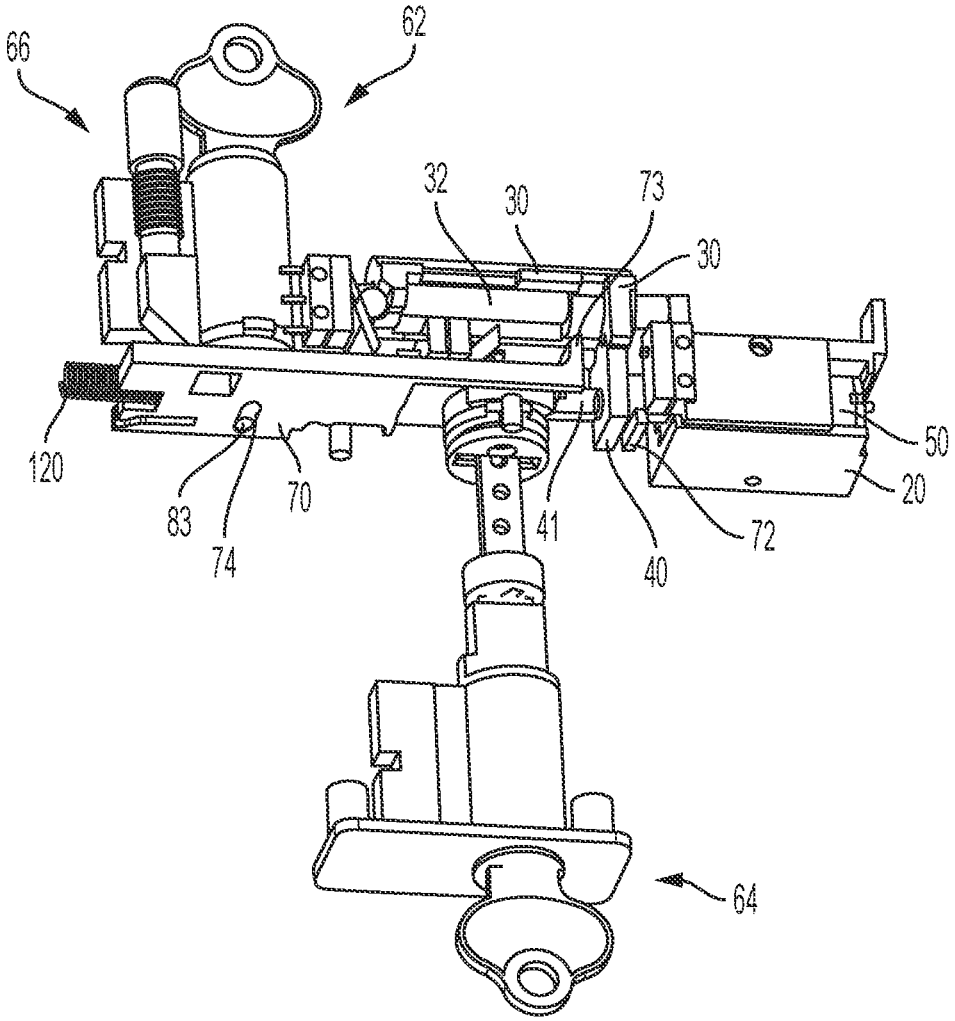
FIG. 3A is an isometric view of the electric strike shown in FIG. 2B with the electric strike in a neutral position and the blocking element in the blocking position.
Figure 3B:
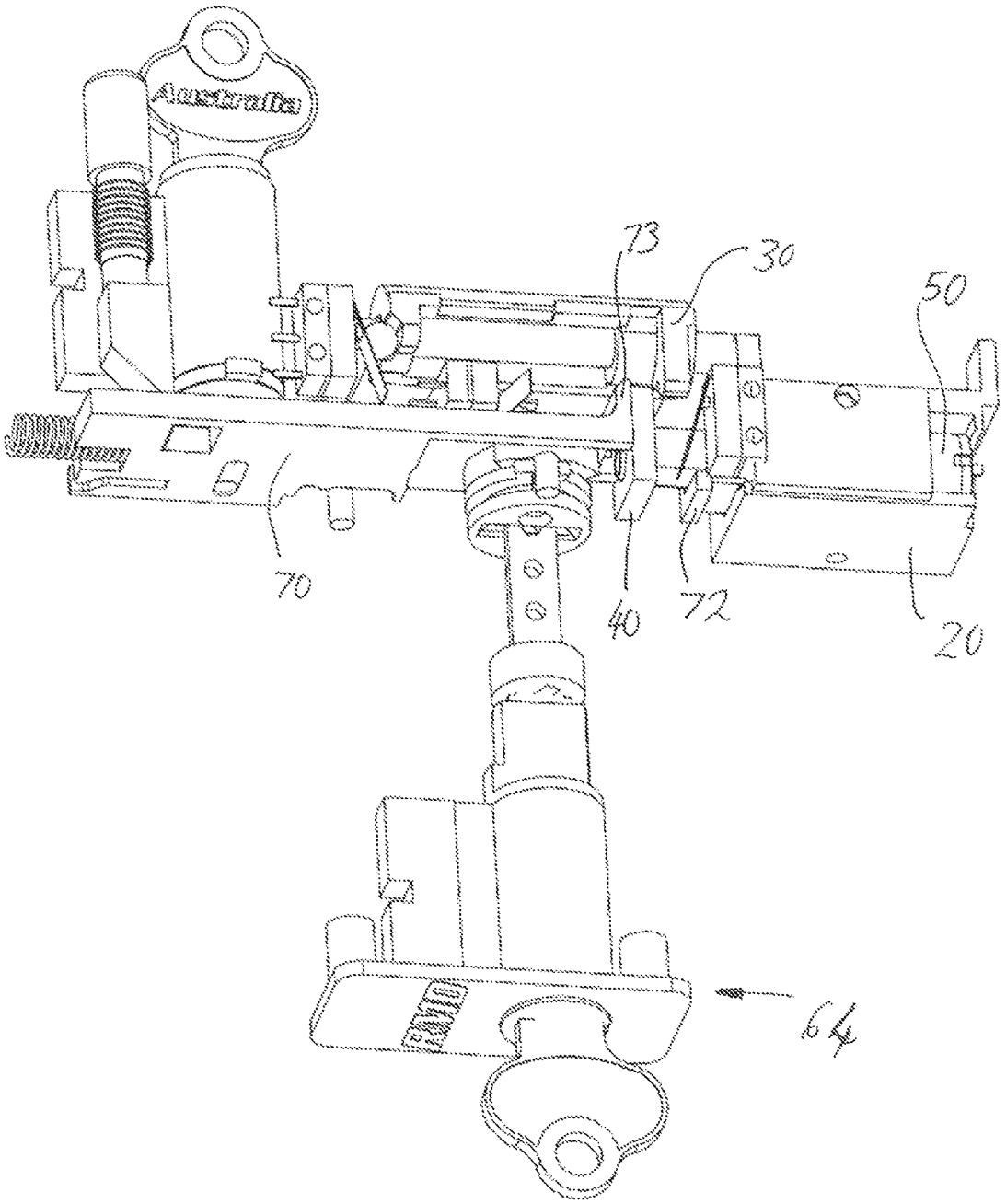
FIG. 3B is an isometric view of the electric strike shown in FIG. 3A in the neutral position with the blocking element driven into the un-blocking position by the electronically controlled actuator.

Referring to FIGS. 2B, 3A and 4A, the indoor key override actuator 62 is one of the components of the override mechanism 60 and has a key cylinder 80 associated with the push bar 70. The key cylinder 80 is a standard key lock cylinder. The key cylinder 80 is coupled to the push bar 70 via the cam 82. Specifically, the cam 82 has a protrusion 83 that locates in slot 74 in the push bar 70. Rotation of a corresponding key 81 in the key cylinder 80 causes the cam 82 to rotate, thereby causing the push bar 70 to translate into an override position and pull the blocking element 40 into the non-blocking position (FIG. 4A). As the push bar 70 pulls the blocking element 40 the spring 94 in the spring housing 90 is compressed. In other words, the indoor key override actuator 62 overcomes the bias provided by the spring 94 in order to move the blocking element from the blocking position into the non-blocking position. As a result, the motor 50 is not forced to rotate in order for the blocking element 40 to be moved by the indoor key override actuator 62.

A biasing member, shown as return spring 120, biases the push bar 70 into a neutral position in which the first contact surface 72 of push bar 70 is not in contact with the blocking element 40. When the user turns the corresponding key 81 to the neutral position so that the key can be removed the return spring returns the push bar 70 to the neutral positon (FIG. 3A).

Figure 4B:
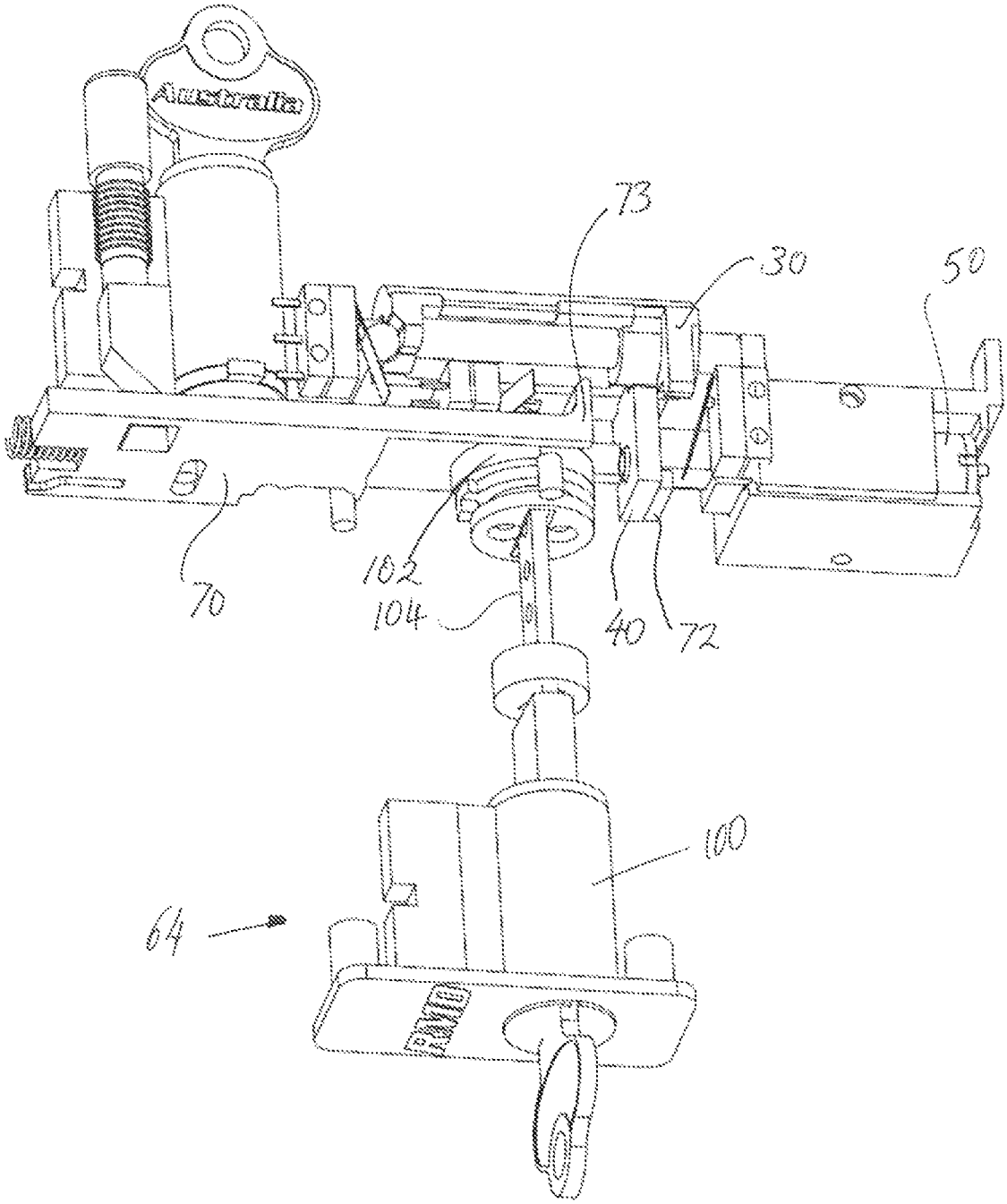
FIG. 4B is an isometric view of the electric strike shown in FIG. 3A in the unlocked position with the blocking element driven into the un-blocking position by the outside door override mechanism.

Referring to FIGS. 2B and 4B, the outdoor key override actuator 64 will now be discussed. The outdoor key override actuator 64 uses the same push bar 70 to override opening of the strike. The outdoor key override actuator 64 has a key cylinder 100 associated with the push bar 70. The key cylinder 100 is a standard key lock cylinder. When a corresponding key 101 is inserted into the key cylinder 100 a tail bar 104 couples the key cylinder 100 to a cam 102. In other words, the key cylinder 100 can be selectively engaged with the cam 102. The corresponding key 101 for the outdoor key cylinder 100 can, and preferably is, identical to the corresponding key 81 for the indoor key cylinder 80, so that the same key can be used to use both the indoor key override actuator 62 and the outdoor key override actuator 64.

The key cylinder 100 is attached to the push bar 70 via the cam 102. The cam 102 has a protrusion 103 that locates in slot 75 in the push bar 70. Rotation the corresponding key 101 in the key cylinder 100 causes the cam 102 to rotate, thereby causing the push bar 70 to translate and pull the blocking element 40 into the non-blocking position (FIG. 4B). As the push bar 70 pulls the blocking element 40 the spring 94 in the spring housing 90 is compressed. In other words, the outdoor key override actuator 64 overcomes the bias provided by the spring 94 in order to move the blocking element 40 from the blocking position into the non-blocking position.

As the indoor key override actuator 62 and the outdoor key override actuator 64 both utilise a common push bar 70, the cams 82, 102 are "lazy" cams. The "lazy" cams allow the push bar 70 to move without the rotation of the lock cylinders 80,100, meaning that the key override can be used with the indoor key 81 (or outdoor key 101) when the outdoor key 101 (or indoor key 81) is in the opposite lock cylinder.

Because the key override actuators 62, 64 are located on the electric strike 10 the latchbolt 212 does not need to be handle activated, and can simply be a retractable latchbolt with no direct means for retracting the latchbolt 212. This can significantly reduce the cost of the fittings required for the door as complex components are only required to be fitted to the frame, rather than both the frame and the door itself (as would be done for a conventional electric strike door).

Figure 4C:
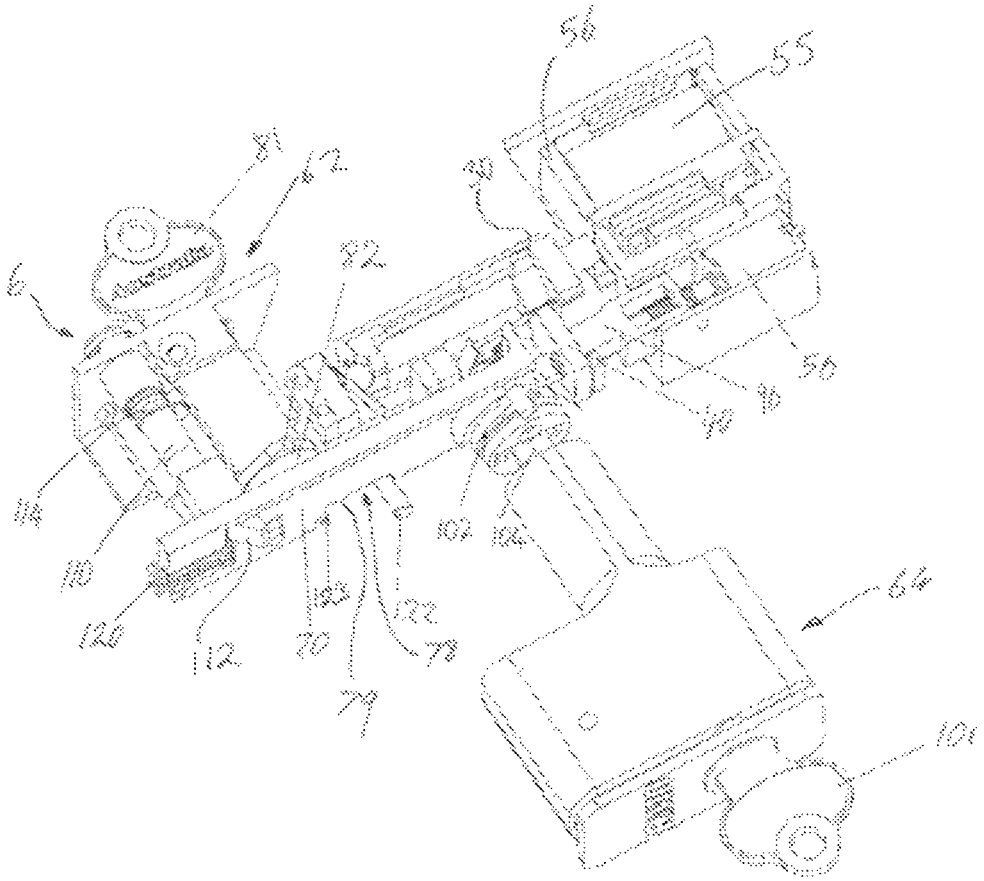
FIG. 4C is an isometric view of the electric strike shown in FIG. 3A in the unlocked position with the blocking element driven into the un-blocking position by the push button override mechanism.
Figure 5:
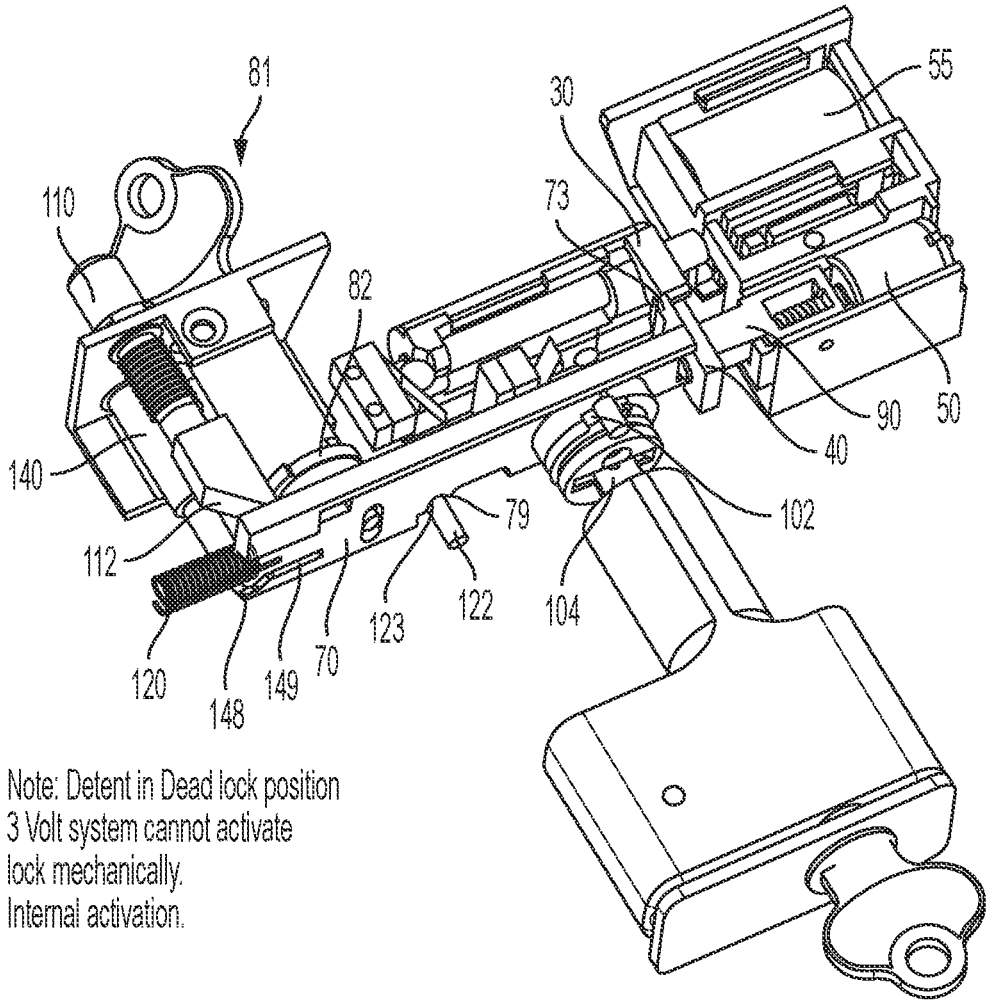
FIG. 5 is an isometric view of the electric strike shown in FIG. 2B with the push bar in the deadlock position.
Figure 6:
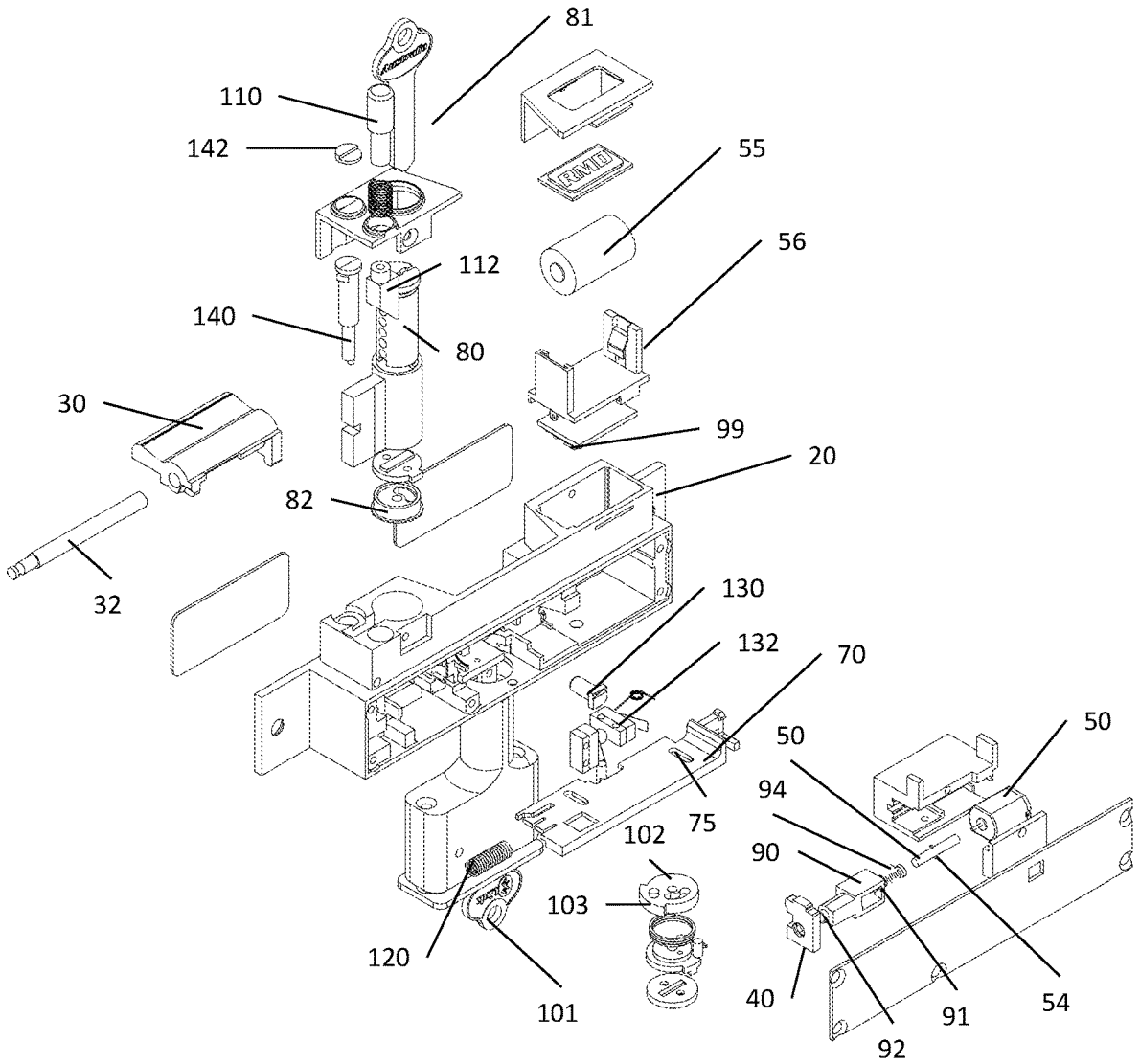
FIG. 6 is an exploded isometric view of the electric strike shown in FIG. 2A.
Figure 7:
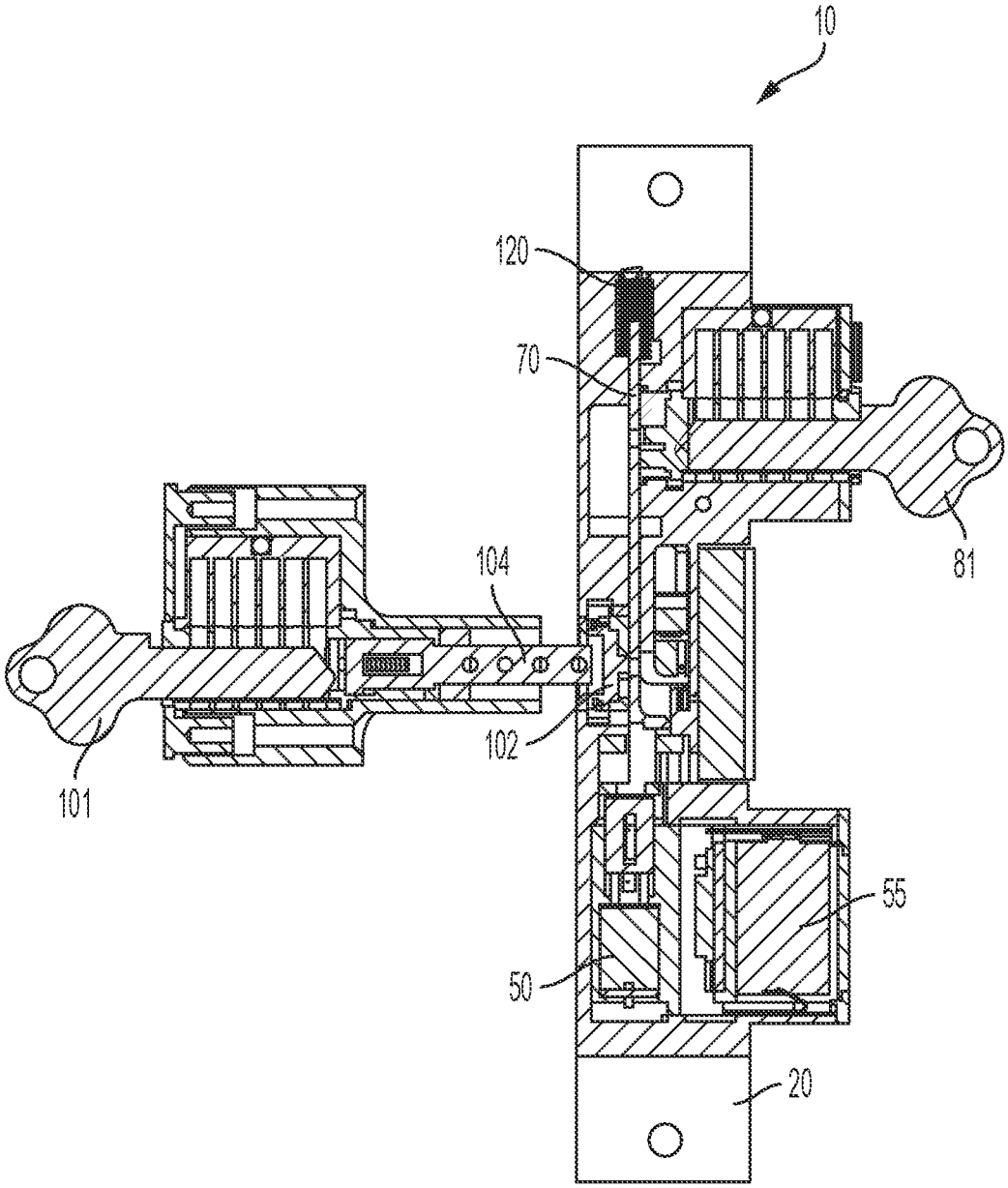
FIG. 7 is a cross section of the electric strike shown in FIG. 1B.

Referring to FIGS. 2B and 4C, the indoor push-button override actuator 66 will now be discussed. The indoor push-button override actuator 66 uses the push bar 70 that is utilised in the indoor key override actuator 62 and the outdoor key override actuator 64. In other words, three override actuators share a common override member, or push bar 70. The indoor push-button override actuator 66 has an elongated push button body 110 that has a first end extending out of the housing 20 so to be accessible by a user and a cam, shown as an inclined surface 112, at an opposite end that interacts with the push bar 70. Specifically, the inclined surface 112 aligns with a corresponding contact surface (not shown) on the push bar 70 that leads into an aperture 77. The contact surface is inclined to urge the push bar to slide under a pushing force on the push button body 110. Inclined surface 112 on the push button actuator extends through aperture 77 and through the push bar 70 when the push button 110 is depressed by a user (FIG. 4C).

When a user pushes the push button 110 the inclined surface 112 on the push-button actuator 66 contacts the inclined contact surface on the push bar 70, thereby causing the push bar 70 to translate and pull the blocking element 40 into the non-blocking position (FIG. 4C). As the push bar 70 pulls the blocking element 40 the spring 94 in the spring housing 90 is compressed. In other words, the push-button override actuator 66 overcomes the bias provided by the spring 94 in order to move the blocking element 40 from the blocking position into the non-blocking position. When the user releases the push button 110 a biasing member, shown as return spring 114, returns the push button 110 to the original position and the return spring 120 returns the push bar 70 to the neutral position.

It is noted that depending on the length of the aperture 77, the push-button override actuator which moves the push bar 70 into the unlocked position, can be made to unlock the strike when the push bar is initially only in the neutral position (ie. before actuation of the push button), or when the push bar is either in the neutral position or the deadlocked position.

As the push-button override actuator is located on the inside of the door the electric strike 10 can be designed as fail-secure device (which when electrical power is lost the electric strike is locked) because the push button allows a person inside the door to exit safely. This also prevents unwanted persons form entering the building when power is lost to the device.

As discussed previously and referring to FIGS. 2B and 5, the electric strike 10 includes an override mechanism that prevents the blocking element 40 from moving to the un-blocking position when the electronically controlled actuator is activated, namely the strike has a deadlocking mechanism in which a deadlocked position can be set. When the electric strike 10 is deadlocked, actuation of the electronically controlled actuator (e.g. motor 50) does not result in the blocking element 40 being driven into the un-locking position. In the embodiment shown in the figures the deadlocking mechanism is activated by a second contact surface 73 on the push bar 70 blocking movement of the blocking element. Either of the key cylinders 80, 100 can be used to drive the push bar 70 into the deadlock position (FIG. 5) (or the push-button actuator 66 if so selected). In the deadlock position the second surface 73 contacts a the blocking element 40, thereby preventing the blocking element 40 from moving out of the blocking position. Second contact surface 73 via push bar 70 prevents translation of the blocking element 40 because push bar 70 cannot itself be moved away from the deadlocked position under the force of the motor actuating movement of the blocking element 40.

To move the push bar 70 into the deadlock position the key 81, 101 is turned in the opposite direction to the direction required to move the push bar into the open, neutral position. In the embodiment shown turning the key 81, 101 clockwise moves the push bar 70 into the deadlock position. A detent 122 retains the push bar 70 in the deadlock position when the corresponding key 81, 101 is removed from the key cylinder 80, 100. During normal use (i.e. when the electric strike is not deadlocked and is in the neutral position) the detent 122 slides in a cut-out 78 when the push bar 70 is moved between the neutral position (FIG. 2B) and the open position (FIG. 4A). When the push bar 70 is moved into the deadlock position the detent 122 rides over a stop 79 in the cut-out 78 and into a push bar deadlocking recess 123.

As described above, when the electric strike 10 is deadlocked, actuation of the motor 50 does not result in the blocking element 40 being driven into the un-locking position. Instead, the spring 94 in the spring housing 90 is compressed. In addition, when the electric strike 10 is deadlocked it is not possible for a user to push the push button 110 as the inclined surface 112 is not in alignment with the inclined contact surface of the push bar 70. If a user attempts to push the push button 110 the push button 110 will not depress as the inclined surface 112 is in contact with a flat surface of the push bar 70. Only turning the key in the key cylinder can move the push bar 70 from the deadlock position (FIG. 5) back to the neutral position (FIG. 3A).

The electric strike 10 has a deadlock indicator, shown as indicator pin 140. The indicator pin 140 has a round front face 142 with two colour sections, typically a green section and a red section. The body 20 of the electric strike 10 has a window 22 that allows a user to view half of the front face 142 of the indicator pin 140. The indicator pin 140 has a protrusion 148 that is eccentrically mounted to the pin 140. The protrusion 148 slides in a channel 149 in the push bar 70. The channel 149 in the push bar 70 has a diverting section that, in combination with the eccentrically mounted protrusion 148, causes the indicator pin 140 to rotate 180 degrees then the push bar 70 is moved from the neutral position to the deadlocked position. When the push bar 70 is in the neutral position the green section of the indicator pin is visible by a user through the window 22, and when the push bar 70 is in the deadlocked position the red section of the indicator pin is visible by a user through the window 22.

In an alternative embodiment the indicator pin 140 does not rotate between green and red sides for indicating that the neutral or deadlocked status of the push bar, and hence electric strike. Rather, the rotating pin can be replaced by a linear sliding component.

Referring back to the actuation of the motor 50, the motor can either be hard wired into the building electronics or, as shown in the figures, the motor can be battery powered. Electrical wires connect the electronic chip 99 to the motor 50 to enable the electronic chip 99 to drive the motor 50. The electronic chip 99 is powered by a battery 55. The battery 55 sits in a battery housing 56. The electronic chip 99 provides a current for a predetermined time to the motor 50 to drive the shaft 52 the predetermined number of rotations. The battery is less than 12V, and preferably 9V or less, and more preferably 3V or less, and most preferably a 3V battery. Alternatively, and as discussed below in relation to the second embodiment of the electric strike 200, the electronic chip may be hard wired into the building electronics and use a 12V solenoid instead of the motor 50.

Locking bar 70 may have an additional micro-switch (not shown) that is operatable from a position, midway on the locking bar. The micro-switch electrically isolates the solenoid or motor in the locked/deadlocked position in the event that the wires inside the electric strike are intrusively cut to gain illegal entry.

As discussed above, the electronic actuator, namely motor 50 or solenoid 250, of the electric strike may be operated by RFID technology. Alternatively, the motor 50 or solenoid 250 can be remotely activated by a portable (mobile) electronic device, such as a mobile phone. The portable electronic device may communicate with the lock via Bluetooth (e.g. Bluetooth Low Energy), ZigBee, Z-Wave, or any other suitable local wireless communication protocol. The portable electronic device may require a PIN to be entered in order to control the remotely controlled actuator. An advantage of the invention is that the lock can be opened with the convenience of wireless communication technology, such as Bluetooth, however the lock can still be opened manually with a key. This is advantageous as a number of situations can arise in which the Bluetooth access may not function, for example if a mobile device used to remotely control the electronic actuator is unable to be used (e.g. flat battery), or if the battery in the lock is flat, or if the electronics become faulty or damaged.

It is envisaged that the motor 50 in the electric strike 10 can have three different modes of operation. It is envisaged that the user will be able to change between the three modes using an application ("App") on the portable electronic device.

The first mode is the "passive" mode, in which the motor is actuated automatically. In "passive" mode when a user approaches, with their phone in their pocket or bag, the electric strike 10 will automatically detect a short range signal (such as a Bluetooth signal) from the phone and actuate the motor 50 to drive the blocking element 40 into the unblocking position. The distance inside which the portable electronic device need to be in order for the electric strike to allow access can be set in the App and is restricted by the wireless communication protocol used.

The second mode is a "prompted" mode, in which the user is required to confirm that they wish for the motor 50 to actuate. In "prompted" mode when a user approaches the door the electric strike 10 automatically detects the signal from the phone and wait to receive a confirmation signal before actuating the motor 50. At the same time the user's phone will detect the signal from the electric strike and will prompt the user with a "Yes"/"No" question regarding whether they wish for the electric strike 10 to be unlocked. If the user selects "Yes" the electric strike 10 actuates the motor 50 to drive the blocking element 40 into the unblocking position. If the user selects "No" the electric strike 10 will not actuate the motor 50.

The third mode is a "prompted pin" mode, in in which the user is required to confirm that they wish for the motor 50 to actuate by inputting a specific PIN. This mode works in the same way as the "prompted" mode, with the additional layer of security requiring a PIN to be input. This additional security is advantageous as losing a mobile device/phone will not result in an unwanted person being able to unlock the electric strike 10 and gain access as the PIN is required to be input when prompted. It is envisaged that the user will set the PIN through the App on the portable electronic device.

The electric strike 10 can therefore be unlocked with the convenience of Bluetooth, however the electric strike 10 can still be unlocked manually by the key 81, 101. This is advantageous as a number of situations can arise in which the remote access may not function, for example if the mobile device is unable to be used (e.g. flat battery), or if the battery in the electric strike is flat, or if the electronics become faulty or damaged. As all of the electronics are contained in the electric strike 10, and battery powered, the lock does not need to be hard wired into power from the home. This simplifies the lock and reduces the chance of the electronic components being damaged during installation. In addition, the locksmith does not need to connect up any additional wires, making Referring to FIG. 7, the key cylinder 100 of the outdoor override actuator 64 has a tail bar 104 that is used to selectively couple the key cylinder 100 to the cam 102. The tail bar 104 that is supplied to the locksmith is oversized. This allows the locksmith to cut the tail bar to size to accommodate door frames of different thickness with a single tail bar (once cut to size). The tail bar 104 is cut to size so that when a key 101 is not inserted into the key cylinder the tail bar 104 does not engage with the cam 102, and when the key 101 is inserted into the key cylinder the tail bar 104 does engage with the cam 102.

While the invention has been described as having a push bar 70 that pulls the blocking element, it is envisaged that the blocking element could instead be pushed instead out of the blocking position.

Referring to FIGS. 8A to 8E, a second embodiment of an electric strike 200 is described. The second embodiment of the electric strike 200 has the same internal components as the first embodiment of the electric strike 10 and operates in the same manner but differs in that rather than having a battery operated motor, the blocking element 40 in electric strike 200 is actuated by a solenoid 250. The solenoid can be a 12 volt solenoid, but other suitable solenoid voltages that are known to be used with electric strikes would also be suitable.

Figure 8A:
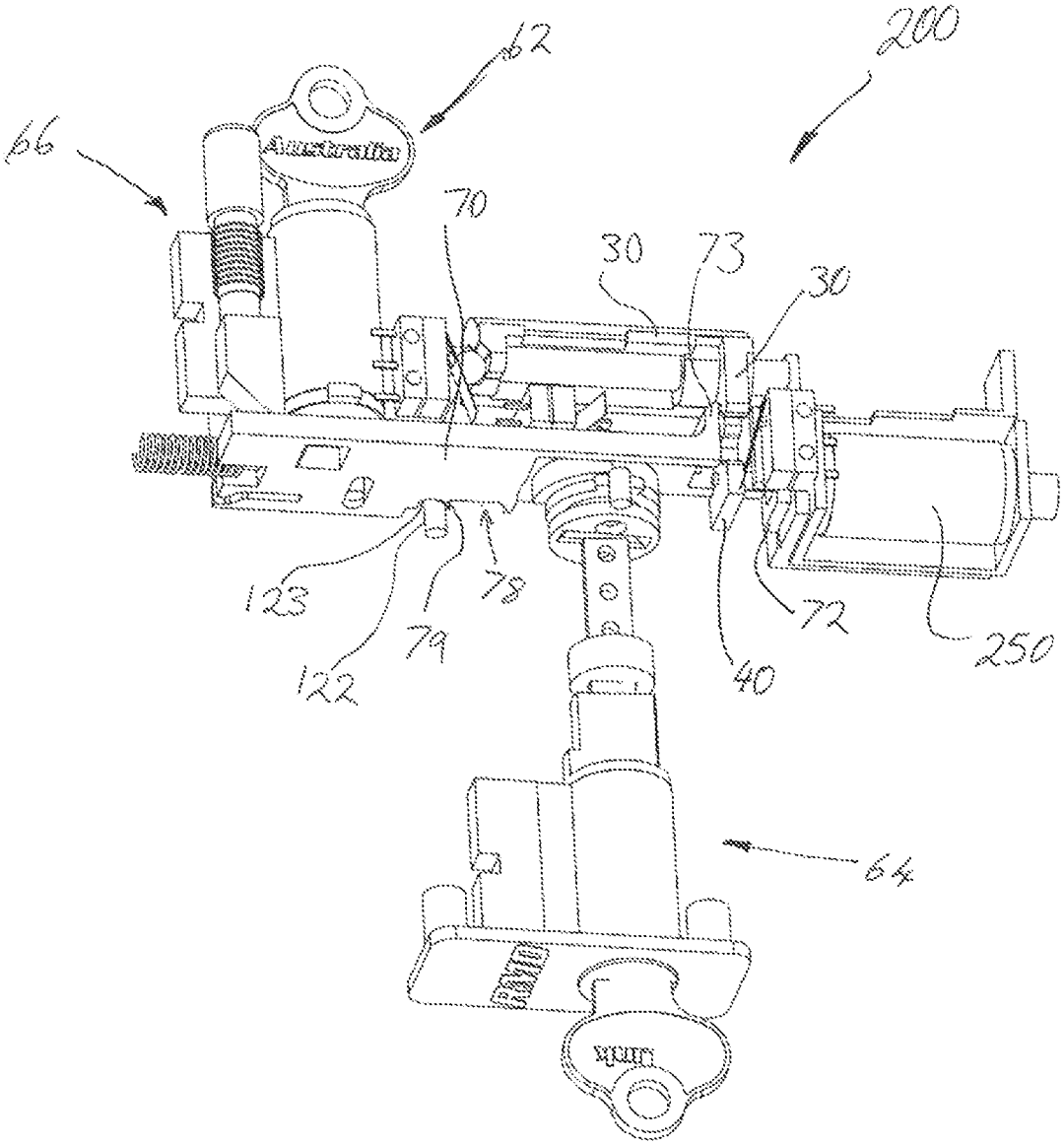
FIG. 8A is an isometric view of a second embodiment of an electric strike in a deadlocked position.

FIG. 8A illustrates electric strike 200 in a deadlock position where push bar 70 has been slidingly translated to its far right position in FIG. 8A by either outdoor key override actuator 64 or indoor key override actuator 62. In this deadlocked position second contact surface 73 sits near or against blocking element 40 so that if solenoid 250 is activated to move blocking element out of engagement with the latch bolt's keeper 30, the push bar 70 will stop movement of the blocking element. It is noted that deadlocking recess 123 in cut-out 78 is defined by a stop 79. Detent 122 sits in deadlocking recess 123 to retain the push bar in the deadlocked position. In this position only a key override through indoor or outdoor key actuators 62, 64 (or the push-button actuator if the strike is designs to retract from deadlock by push-button) will retract push bar 70 out of the deadlocked position by forcing detent 122 over stop 79 and into the normal (neutral) operating condition, as shown in FIG. 8B.

Figure 8B:
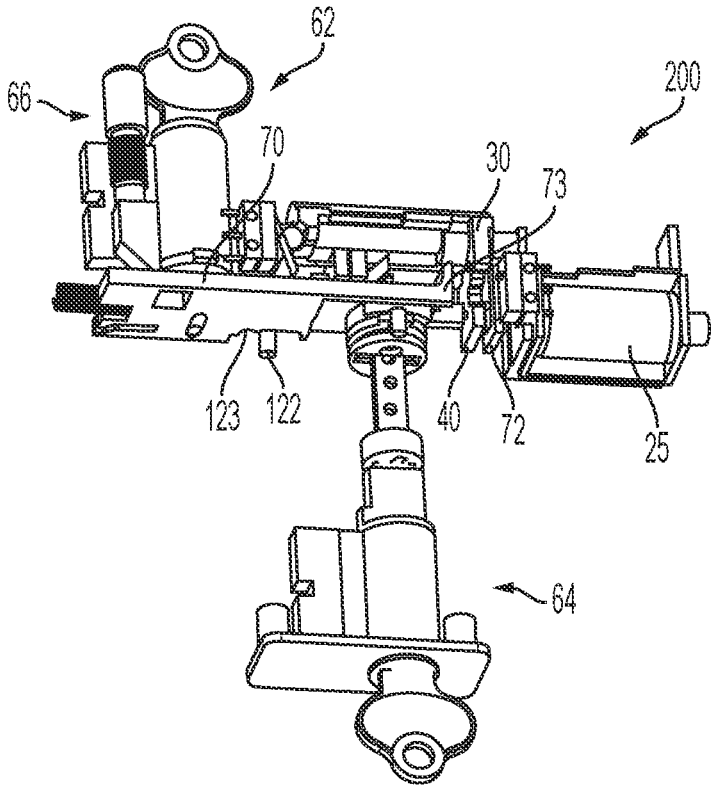
FIG. 8B shows the second embodiment of the electric strike of FIG. 8A in a neutral but locked position.
Figure 8C:
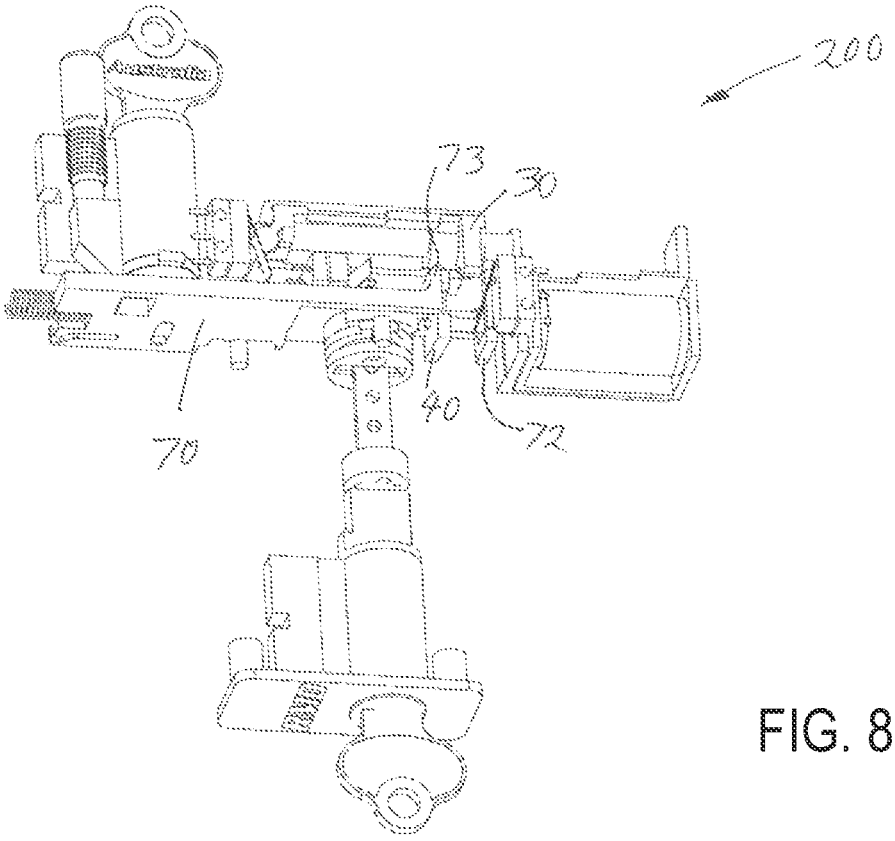
FIG. 8C shows the electric strike of FIG. 8A in a neutral and unlocked position.

FIGS. 8B and 8C illustrate the electric strike in a neutral position, where push bar 70 has been moved towards the left of FIG. 8B out of the deadlocked position. A gap can be seen between second contact surface 73 of push bar 70 and blocking element 40, which gap is sufficient to allow blocking element to be actuated by solenoid 250 and move from the keeper/latch bolt blocking position of FIG. 8B to the unblocking position of FIG. 8C in which the keeper 30 and latch bolt are free to pivot and allow a door to be opened.

Figure 8D:
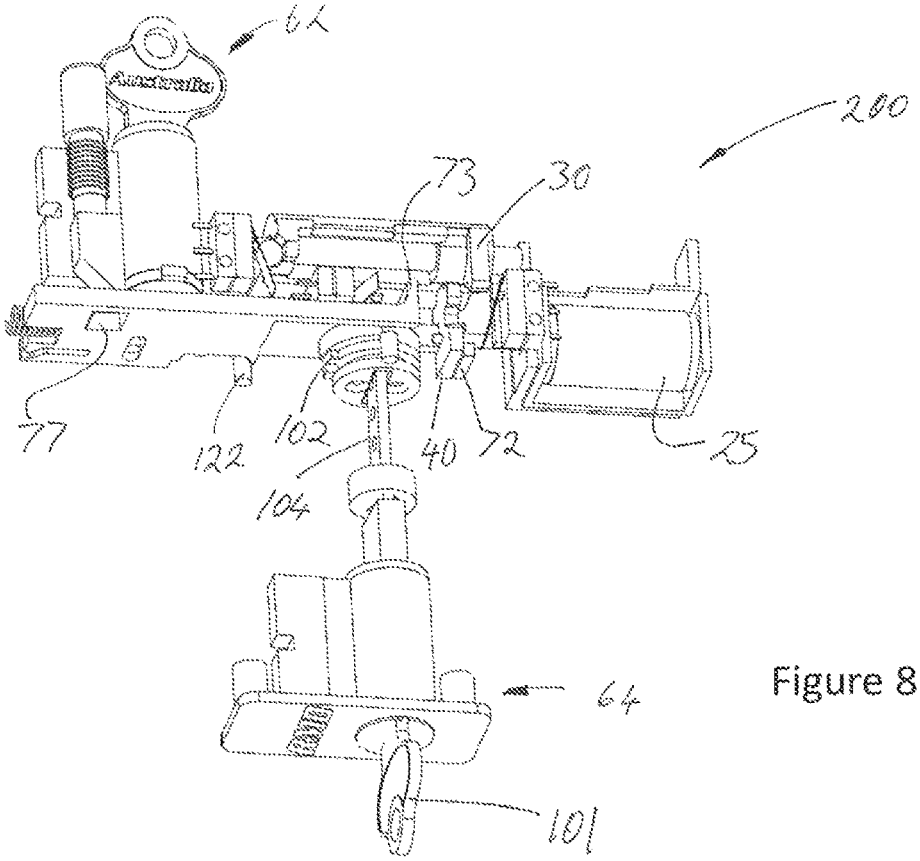
FIG. 8D shows the electric strike of FIG. 8A moved to an unlocked position by the external key override.

FIG. 8D shows an unlocked position of the electric strike 200 in which the outdoor key override actuator 64 is actuated by key 101 to retract push bar 70 to its far left position of FIG. 8D whereby the first contact surface 72 of push bar will catch on blocking element 40 and pull it out of the blocking position, as shown in FIG. 8B, and into the non-blocking position. The outdoor key override actuator may retract the push bar from either the deadlocked position as shown in FIG. 8A or the neutral position as shown in FIG. 8B.

While not shown, the indoor key override actuator 62 will operate in the same way as shown in FIG. 8D to unlock the electric strike, but by using key 81 to actuate indoor key override actuator 62.

Figure 8E:
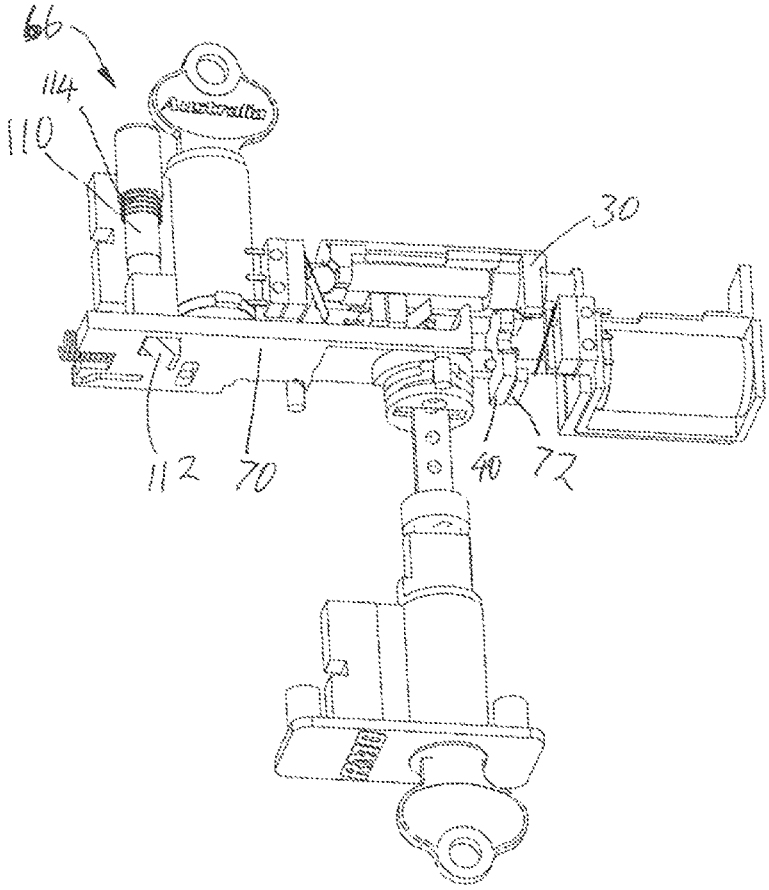
FIG. 8E shows the electric strike of FIG. 8A moved to an unlocked position by the manual push button override.

FIG. 8E illustrates the indoor push-button override actuator 66 being pushed against the biasing force of its spring 114 so that the inclined surface 112 of the push button 110 rides along an inclined contact surface (not shown) on push bar 70 that leads into aperture 77. The pushing force of the push button will cause push bar 70 to slide to the left of FIG. 8E from the neutral position to an unlocked position in which the electric strike 200 will allow a door to open.

Accordingly, the presently described electric strikes 10, 200 allow for electronic access through a door, namely access generated by an electric signal such as by RFID card, Bluetooth or electric switch, but also allows at the same time for access to be obtained mechanically, e.g. by way of key or mechanical button/switch, by overriding the electronics. Furthermore, the electric strikes 10, 200 have the capacity of locking out the electronic access function in the electric strikes, to the exclusion of all but mechanical access, and in particular physical keyed access. These features of override and/or lockout provide advances and functional flexibility not previously known in electric strikes.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. An electric strike for a door frame, comprising:

a body;

a keeper moveably attached to the body for selectively retaining a latch on a door;

a blocking element movable between a blocking position in which the blocking element locks the keeper to prevent the latch from being moved past the keeper, and an unblocking position in which the blocking element unlocks the keeper to allow the latch to move past the keeper;

an electronically controlled electric actuator for moving the blocking element between the blocking position and the unblocking position;

an override mechanism operable to override the electric actuator; and a biasing member that biases the override mechanism to a normal operating condition in which the override mechanism does not override the electric actuator.

2. The electric strike claimed in claim 1, wherein the override mechanism blocks movement of the blocking element.

3. The electric strike claimed in claim 1, wherein the override mechanism moves the blocking element to the unblocking position.

4. The electric strike claimed in claim 1, wherein the override mechanism is a mechanical override mechanism.

5. The electric strike claimed in claim 1, wherein the override mechanism comprises an override member that moves to reciprocate between a deadlocked position in which the override member prevents the blocking element from moving out of the blocking position, and an unlocked position in which the override member moves the blocking element into the unblocking position.

6. The electric strike claimed in claim 5, wherein the override member further moves to a neutral position between the deadlocked position and the unlocked position, with the neutral position of the override member corresponding to the normal operating condition of the override mechanism.

7. The electric strike claimed in claim 5, wherein the override mechanism comprises one or more mechanical actuators to actuate the override member into the deadlocked position or the unlocked position.

8. The electric strike claimed in claim 5, wherein the override member is a sliding bar having two contact surfaces joined by a bridge, wherein the blocking element is captured between the contact surfaces and slides along the bridge.

9. The electric strike claimed in claim 8, wherein a first surface of the two contact surfaces abuts the blocking element to prevent the blocking element from moving out of the blocking position.

10. The electric strike claimed in claim 8, wherein a second surface of the two contact surfaces pulls the blocking element out of the blocking position and into an unblocking position as the sliding bar moves to an unblocking position.

11. The electric strike claimed in claim 6, wherein the biasing member is a return spring that biases the override member to the neutral position in which the override member does not interfere with the blocking element.

12. The electric strike claimed in claim 1, wherein the electric actuator is motor powered by a battery or the electric actuator is a solenoid hard wired into an electronic circuit.

13. The electric strike claimed in claim 1, further comprising a deadlock indicator on the body and visible from the exterior of the body.

14. The electric strike claimed in claim 1, wherein the electric actuator is actuated by a portable electronic device using a local wireless communication protocol.

15. The electronic strike claimed in claim 14, wherein the portable electronic device requires a Personal Identification Number (PIN) in order to actuate the electronic actuator.

16. An electric strike for a door frame, comprising:

a body;

a keeper moveably attached to the body for selectively retaining a latch on a door;

a blocking element movable between a blocking position in which the blocking element locks the keeper to prevent the latch from being moved past the keeper, and an unblocking position in which the blocking element unlocks the keeper to allow the latch to move past the keeper;

an electronically controlled electric actuator for moving the blocking element between the blocking position and the unblocking position; and an override mechanism operable to override the electric actuator;

wherein the override mechanism comprises an override member that moves to reciprocate between a deadlocked position in which the override member prevents the blocking element from moving out of the blocking position, and an unlocked position in which the override member moves the blocking element into the unblocking position; and wherein the override member is a sliding bar having two contact surfaces joined by a bridge, wherein the blocking element is captured between the contact surfaces and slides along the bridge.

17. The electric strike claimed in claim 16, wherein a first surface of the two contact surfaces abuts the blocking element to prevent the blocking element from moving out of the blocking position.

18. The electric strike claimed in claim 16, wherein a second surface of the two contact surfaces pulls the blocking element out of the blocking position and into an unblocking position as the sliding bar moves to an unblocking position.

* * * * *